US006527580B1

(12) United States Patent
Süss et al.

(10) Patent No.: US 6,527,580 B1
(45) Date of Patent: Mar. 4, 2003

(54) SCREWLESS TERMINAL

(75) Inventors: Christian Süss, Strullendorf (DE); Oliver Lang, Bamberg (DE); Michael Burger, Trunstadt (DE)

(73) Assignee: Wieland Electric GmbH, Bamberg (DE)

( * ) Notice: Subject to any disclaimer, the term of this patent is extended or adjusted under 35 U.S.C. 154(b) by 0 days.

(21) Appl. No.: 09/913,789

(22) PCT Filed: May 9, 2000

(86) PCT No.: PCT/EP00/04125

§ 371 (c)(1),
(2), (4) Date: Aug. 16, 2001

(87) PCT Pub. No.: WO00/70714

PCT Pub. Date: Nov. 23, 2000

(30) Foreign Application Priority Data

May 14, 1999 (DE) ..... 199 21 960
Sep. 16, 1999 (DE) ..... 199 44 431

(51) Int. Cl.[7] ..... H01R 4/24

(52) U.S. Cl. ..... 439/417; 439/409; 439/404; 439/402

(58) Field of Search ..... 439/417, 402, 439/404, 395, 392–394, 396–401, 403, 405, 406, 407, 418

(56) References Cited

U.S. PATENT DOCUMENTS

| | | | |
|---|---|---|---|
| 5,620,332 A | | 4/1997 | Gerke et al. |
| 5,772,464 A | | 6/1998 | Hohorst |
| 5,816,843 A | | 10/1998 | Gerberding |
| 6,120,316 A | * | 9/2000 | Allgaier et al. ..... 439/404 |

FOREIGN PATENT DOCUMENTS

| | | |
|---|---|---|
| DE | 85 14 963 | 11/1986 |
| DE | 195 41 137 A1 | 5/1997 |
| DE | 196 03 960 A1 | 7/1997 |
| DE | 298 02 674 U1 | 5/1998 |
| DE | 298 14 208 U1 | 12/1998 |
| DE | 197 49 622 | 2/1999 |
| DE | 299 08 384 U1 | 9/1999 |
| EP | 0 691 706 A1 | 1/1996 |

* cited by examiner

*Primary Examiner*—P. Austin Bradley
*Assistant Examiner*—Alexander Gilman
(74) *Attorney, Agent, or Firm*—Norman N. Kunitz; Venable, LLP

(57) ABSTRACT

A screwless terminal, especially a modular terminal (1), with a conductor bar (3) situated in a terminal housing (2) and with an insulation displacement contact element (4) electro-conductively connected to the conductor bar (3). An electrical conductor (11) that is introduced via a housing lead-through can be contacted between the cutting edges (7, 8) of the insulation displacement contact element (4) whereby the cutting edges (7,8) face each other. The insulation displacement contact element (4) is moveably arranged on the conductor bar (3). Insulation displacement contacting of the fixedly position conductor (11) is carried out by a translation movement of the insulation displacement contact element (4) along the conductor bar (3). An additional actuating element (40) that engages with an actuating tool (13) allows for careful handling during contacting of the conductor (11) by avoiding a direct contact between the actuating tool (13) and a contacting element (4*a*, 4*b*) comprising the insulation displacement contact element (4).

27 Claims, 8 Drawing Sheets

SCREWLESS TERMINAL

Figure 1:
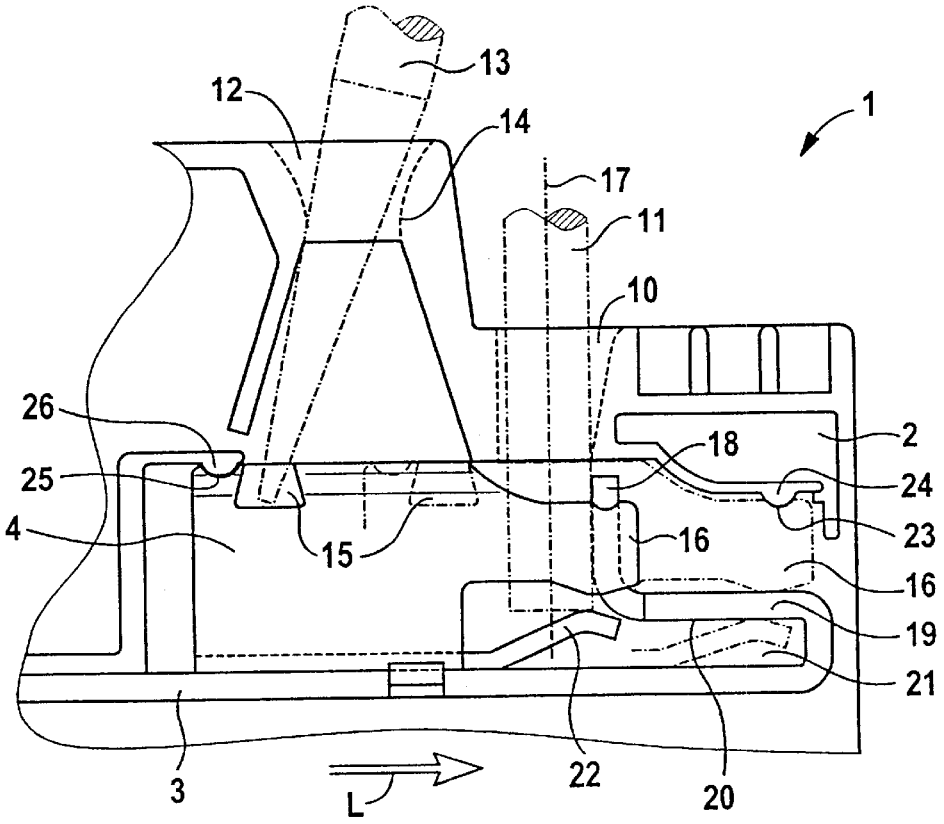

The invention relates to a screwless terminal, in particular a series terminal, comprising an insulation displacement contact that is positioned inside a terminal housing for a conductor rail and is connected electrically conducting to this conductor rail. The electrical conductor can be inserted into the terminal housing via a feed-through in the housing and can be contacted between the opposite arranged cutting edges of this displacement contact.

A plurality of terminal embodiments for contacting and connecting electrical conductors are known, the so-called series-connected terminals, which can be snapped onto support rails or top hat rails. A distinction can be made between screw terminals, for which the electrical conductors are secured by means of clamping screws, and screwless terminals in the form of spring terminals, for which the electrical conductors are contacted through the clamping on of a pressure or tension spring. Whereas the conductor end to be contacted with the aforementioned screw terminals and the spring terminals is first stripped of insulation, so-called insulation displacement terminals or insulation displacement contacts permit a contacting of the conductor without stripping the insulation. Screwless terminals are generally used for contacting the conductor without stripping the insulation.

A screwless terminal using the insulation displacement technique is thus known from European Reference EP 0 691 706 B1, for which the conductor is moved with a translational movement and by means of an auxiliary element against an insulation displacement contact with blade-type cutting contacts. These cutting contacts penetrate the conductor insulation and make contact with the conductor core. The disadvantage of this terminal embodiment is that the openings for inserting the conductor on the one hand and those for the auxiliary element on the other hand are provided on different sides of the terminal housing. In many application cases, this makes the assembly and contacting of the conductor considerably more difficult.

This problem is avoided with a screwless terminal known from German Reference 195 41 137 A1, designed as electrical front wiring terminal, in that an insulation displacement contact positioned inside the terminal housing is pivoted with an actuation tool in a rotating movement against the conductor. This actuation tool is inserted into the terminal housing via the same housing side as the conductor. The disadvantage of this embodiment on the one hand is that the unsatisfactory electrical connection between the insulation displacement contact and the conductor rail connected thereto since this connection simultaneously represents the pivoting joint. Thus, only a practically point-shaped connection can be realized with simultaneous forced weakening of the conductor rail cross section. On the other hand, it is made considerably more difficult to detach the insulation displacement contacting.

Thus, it is the object of the invention to modify a screwless terminal of the aforementioned type, so as to permit a reliable insulation displacement contacting of a conductor while avoiding the aforementioned disadvantages and, at the same time, ensure an easy detachability.

This object is solved according to the invention with the features in claim 1. For this, the insulation displacement contact is arranged so as to be displaceable on the conductor rail. With an immovably positioned conductor, the insulation displacement contacting occurs through a translational sliding movement of the insulation displacement contact along the conductor rail. In the process, opposite arranged cutting edges of the insulation displacement contact cut through the conductor rail insulation by forming a guide and cutting slot and make contact with its conductor core.

The insulation displacement contact has a U-shaped design in order to form the cutting edges, wherein the free ends of the U-shaped legs are bent toward each other to create the cutting and guide slot. The front edge of the insulation displacement contact, meaning of the cutting slot, which faces the conductor if the conductor is inserted into the terminal housing, in that case extends downward at a slant and has a scarfed design.

To be sure, the insulation displacement contacting disclosed in German References DE 298 02 674 U1 and DE 197 49 622 C1 is realized with the aid of a sliding carriage moved with a translational movement. However, the sliding carriages, made of insulating material for the known terminals, must be inserted as additional parts from the outside into the terminal housing or must be moved with a sliding movement on the inside of the housing. In addition, both these embodiments have the disadvantage that the conductor is moved together with the slider in the direction of an insulation displacement contact that is locally fixed inside the terminal housing, so that it can be inserted into its cutting slot.

Starting with this known sliding techniques, the invention is based on the concept that the number of components necessary for the insulation displacement contacting of the conductor can be reduced by moving the insulation displacement contact itself in a translational movement along the conductor rail. As a result, the insulation displacement contacting can occur while the conductor is simultaneously in the resting position, meaning it is immobile. In turn, this permits a particularly reliable and secure positioning and holding of the conductor during the insulation displacement contacting.

The conductor, advantageously positioned rigid and thus immovable inside the terminal housing, is held inside a sleeve-shaped guide following its insertion into the terminal housing and prior to the actual insulation displacement contacting. Above the cutting edges, this sleeve-shaped guide is formed by the housing feed-through and below the cutting edges by guide bars formed onto the insulation displacement contact and extending in longitudinal direction of the rail. These guide bars fit against the conductor prior to the insulation displacement contacting and thus hold the conductor between them.

The electrically conducting connection between the insulation displacement contact and the conductor rail can occur in different ways. The connection for one particularly preferred embodiment occurs by means of a sliding coupling that is formed below one front edge of the insulation displacement contact onto this contact and extends in longitudinal rail direction. The sliding coupling in the process is bent upward against an inward-bent conductor rail section, such that it fits against the underside of the conductor rail section. The bent-in conductor rail section of one useful modification of this embodiment has a free end, bent upward in the direction of the housing feed-through. On the back, meaning on the conductor side facing away from the insulation displacement contact, the free end functions as supporting web for the conductor.

According to an alternative embodiment, a sliding contact on the side is used to establish the electrically conducting connection between the insulation displacement contact and the conductor rail. The insulation displacement contact preferably has two sliding couplings for this, which fit against the opposite-arranged side edges of the conductor rail. With this embodiment, the conductor rail advantageously has a narrowed-down design in the sliding contact region, so that the sliding couplings that are preferably curved inward in the direction of the conductor rail do not or only insignificantly project on the side over the conductor rail.

The electrically conducting connection of another embodiment occurs with a lower and/or upper sliding contact, relative to the conductor rail. For this, a sliding coupling that is formed onto the insulation displacement contact fits against the conductor rail underside, against the conductor rail top, or against both sides of the conductor rail. The sliding coupling formed onto the insulation displacement contact in this case is bent toward the inside, transverse to the longitudinal direction of the rail. For the top and bottom contacting, this sliding coupling, starting from the underside of the conductor rail, is bent over at the top and thus fits with the free end against the conductor rail top while encompassing the conductor rail.

The electrically conducting connection between the insulation displacement contact and the conductor rail furthermore can occur with a sliding contact provided in the center region of the conductor rail. For this, a sliding coupling fits against a contact coupling that is formed onto the conductor rail, which sliding coupling is positioned against the contact coupling and, in turn, is formed onto the insulation displacement contact. This embodiment advantageously has two sliding couplings that accommodate the contact coupling for the conductor rail between them and are formed onto the insulation displacement contact. These sliding couplings are bent inward in the direction of the conductor rail center and fit against the upward bent contact coupling of the conductor rail.

To form the contact coupling, a widened conductor rail section can be slotted on both sides, transverse to the longitudinal rail direction, and can subsequently be bent upward. An alternative method of forming the contact coupling, provides for a conductor rail section that has been bent to an upright position by bending it several times and is aligned parallel to the longitudinal rail direction by subsequently twisting or turning it.

Terminals of this type use the insulation displacement technique to cut the insulation and contact the conductor. An actuation tool, such as a screwdriver that can be inserted from the outside into the terminal housing, is generally provided to supply the necessary force. The screwdriver is used to move the conductor and insulation displacement contact relative to each other. For that reason, the insulation displacement contact has an insertion opening or insertion slot for the conductor and an engagement recess for an actuation tool, which are advantageously arranged successively in movement direction. A funnel-shaped housing well in the terminal housing is aligned with this engagement recess, which can have a dovetailed design. An actuation tool can be inserted via this well from the outside into the terminal housing. The funnel-shaped housing well is tapered in insertion direction. However, below the narrowed section or necking, formed in the process, this well conically expands again in the direction of the engagement recess.

For a particularly advantageous embodiment that also permits a careful handling, an actuation element that operates jointly with the actuation tool is activated for contacting the conductor. The actuation element is designed such that a direct contact is avoided between the actuation tool and the contacting element. For a secure insulation displacement contacting, it is therefore provided that the contacting element encompasses the insulation displacement contact for contacting the conductor, which is held locally fixed inside the terminal housing. The contacting element and the insulation displacement contact thus form a single structural component.

The advantage of the embodiment with the additional actuation element is that the contacting element, for example, cannot be damaged due to an improper insertion of the actuation tool. As a result, a careful actuation is ensured, so that the functional ability of the insulation displacement contact is maintained even with repeated conductor contacting. If the actuation tool is inserted, the actuation element is preferably arranged between this tool and the contacting element.

The actuation element, which is provided with a holding space for the actuation tool, is hollow on the inside and forms a multi-sided guide for the actuation tool. As a result, a direct contact between the actuation tool and the contacting element is avoided, even when disconnecting the contact, meaning with different movement directions of the actuation tool. The actuation tool in that case preferably engages in the contacting element. The loose engagement on the one hand permits a secure guidance of the actuation tool and, on the other hand, ensures an easier handling due to the play. For this, the actuation element preferably is arranged securely inside the terminal housing, so as to avoid the loss of the actuation element.

The housing for one advantageous modification is provided with a projection as support for the actuation element and the actuation element snaps into this support. This arrangement permits an especially easy installation of the actuation element in the terminal housing, in that the actuation element is pushed into the terminal housing via a pressure point determined by the projection. The projection in this case can define a rotational axis for the actuation element. Since the actuation element simultaneously guides the actuation tool, this tool is also rotated around this axis. The projection designed as support thus forms a point of engagement on which the actuation tool is supported. As a result, the terminal housing advantageously absorbs the forces exerted by the actuation tool.

If the actuation element is designed as pivoting lever, in particular having a wedge-shaped convexity as counter-support for the support, an easy insertion of the actuation element into the terminal housing is possible. The actuation element preferably has an elastic design to permit an easy insertion via the projection. The actuation element is preferably designed as one piece to ensure a simple design with respect to production technology.

To make the terminal highly operator-friendly, the actuation element advantageously is provided with a display indicating the movement direction for the open position and the clamping position. As a result, it is easy to see from the outside in what direction the actuation tool must be guided for a clamping contact or to disconnect the contact. One preferred embodiment of the actuation element furthermore is provided with a marking for the contacting element position, so as to be highly operator-friendly and to detect if the inserted conductor is contacted.

Exemplary embodiments of the invention are explained in the following in further detail with the aid of drawings, which show in:

FIG. 1 A view from the side of a screwless terminal with insulation displacement contact, which can be moved via translational movement along a conductor rail.

Figure 2:
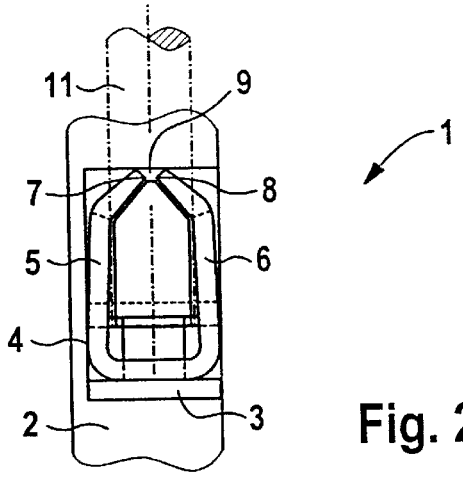
Figure 3:
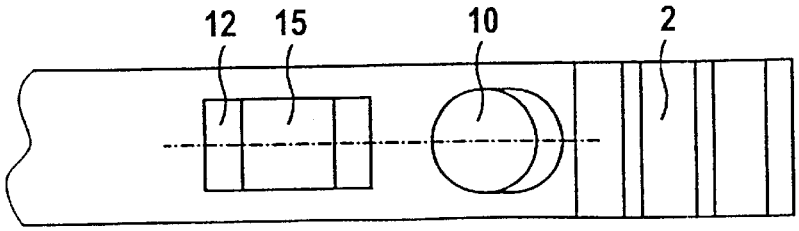

FIGS. 2 and 3 The terminal according to FIG. 1, as a sectional view or a view from above.

Figure 4:
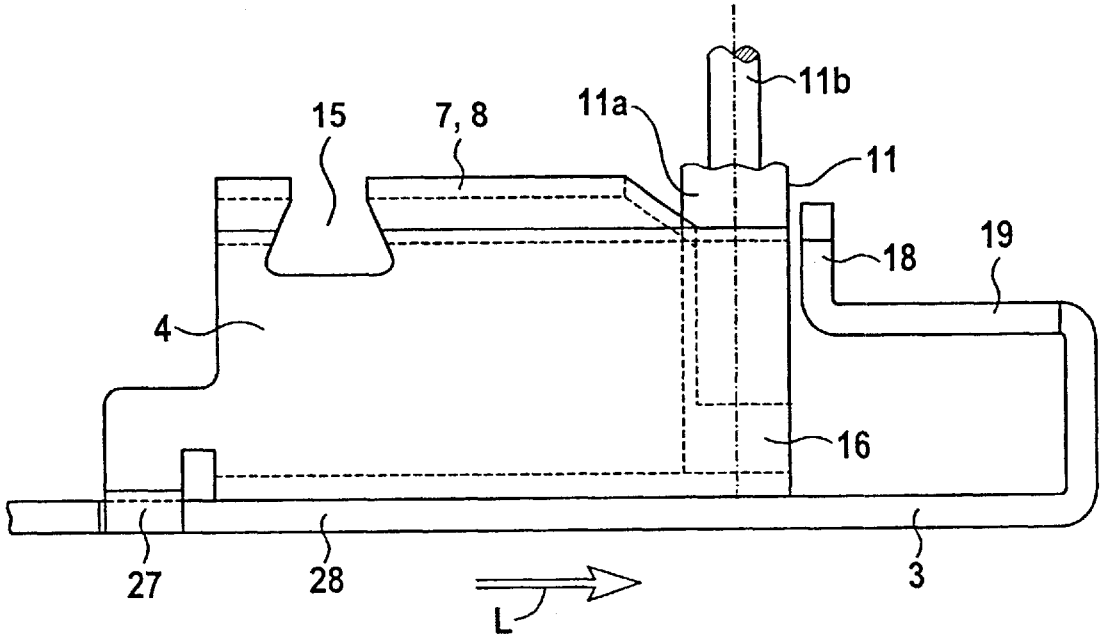
Figure 5:
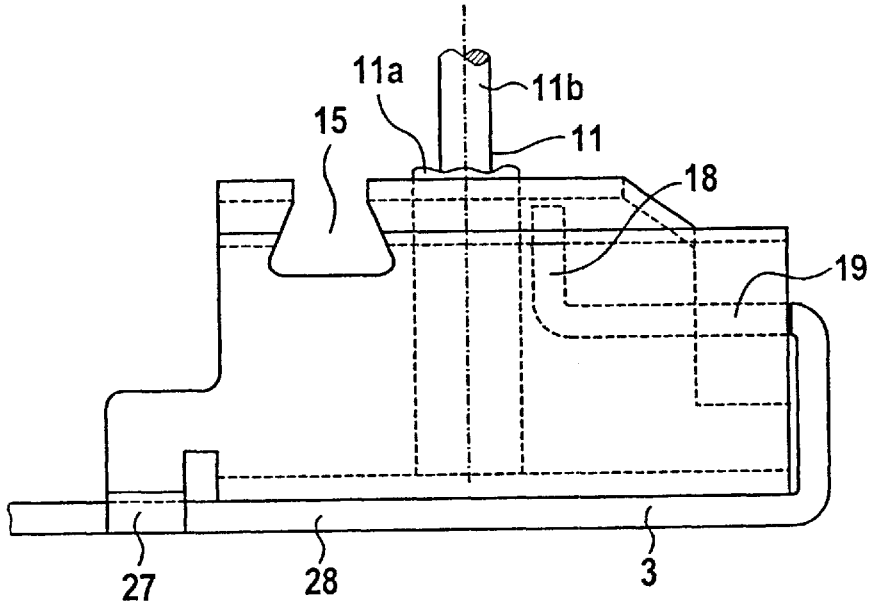

FIGS. 4 and 5 A side view of the functional components of an alternative embodiment of the terminal, with a sliding contacting on the side between the insulation displacement contact and the conductor rail, in the non-contacting or the contacting functional position.

Figure 6:
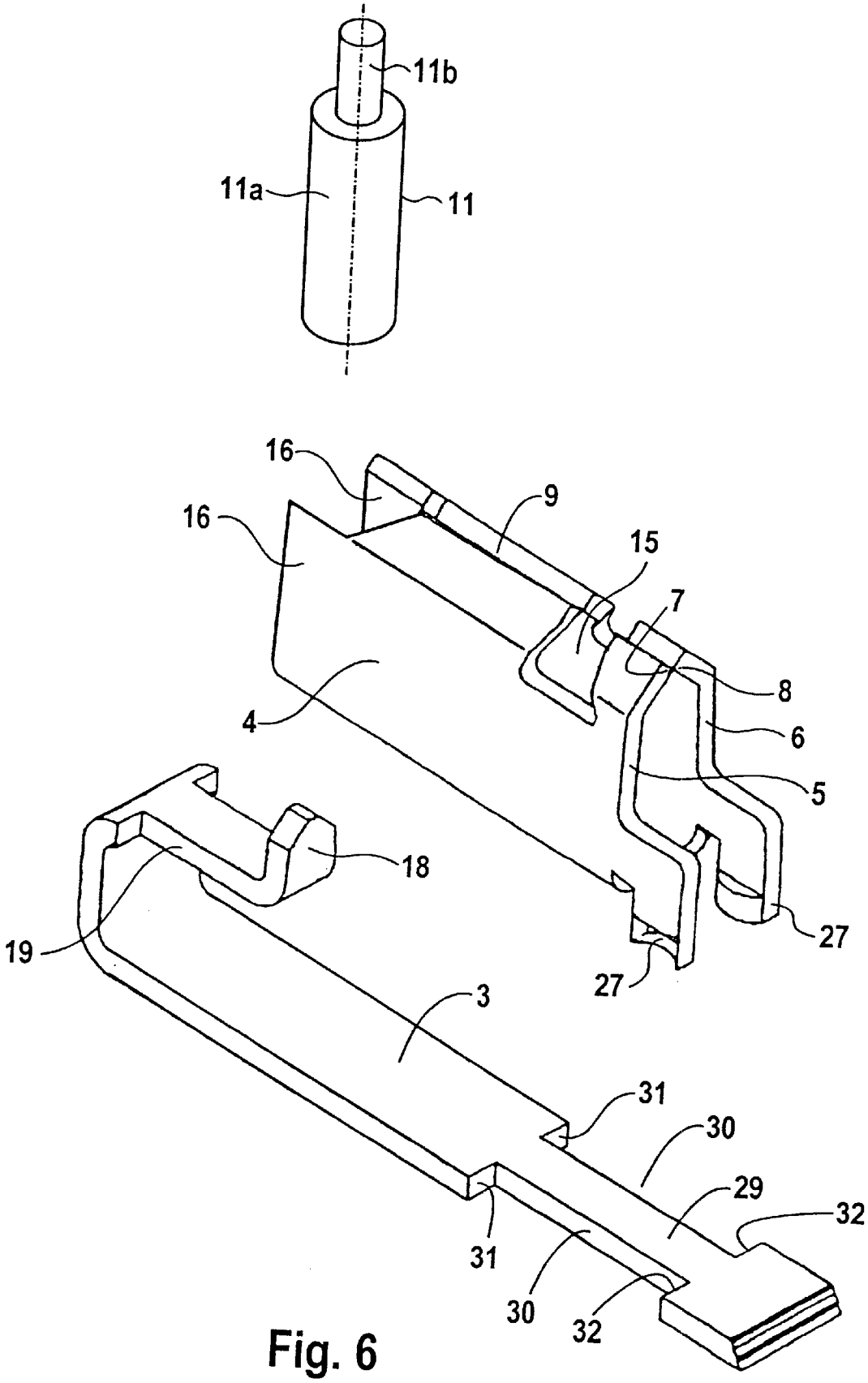

FIG. 6 The functional components of the terminal according to FIGS. 4 and 5, as an exploded view.

Figure 7:
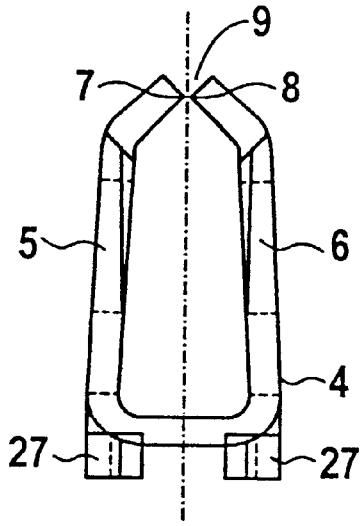
Figure 8:
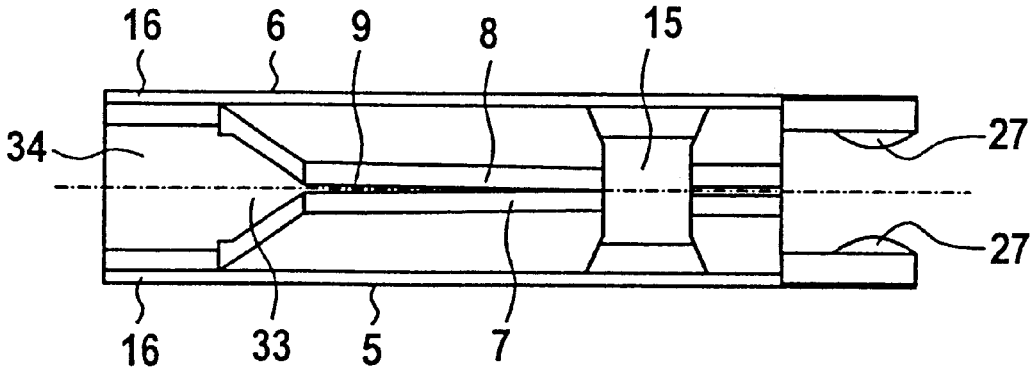

FIGS. 7 and 8 A view from above as well as a view from the front of the insulation displacement contact shown in FIG. 6.

Figure 9:
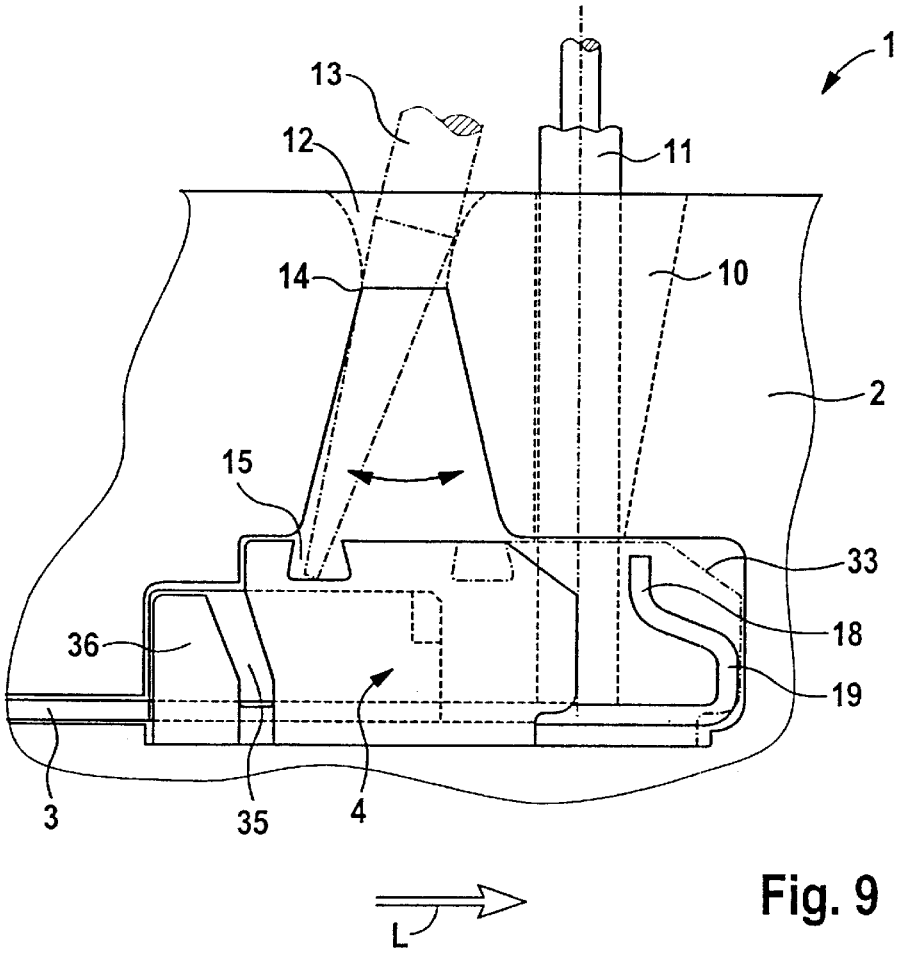

FIG. 9 Another alternative embodiment of the terminal, with a center sliding contact between the insulation displacement contact and the conductor rail.

Figure 10:
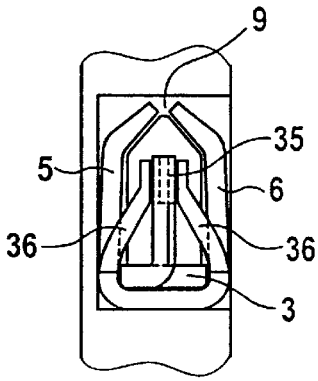
Figure 11:
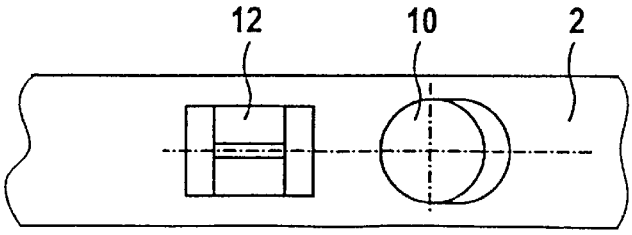
Figure 12:
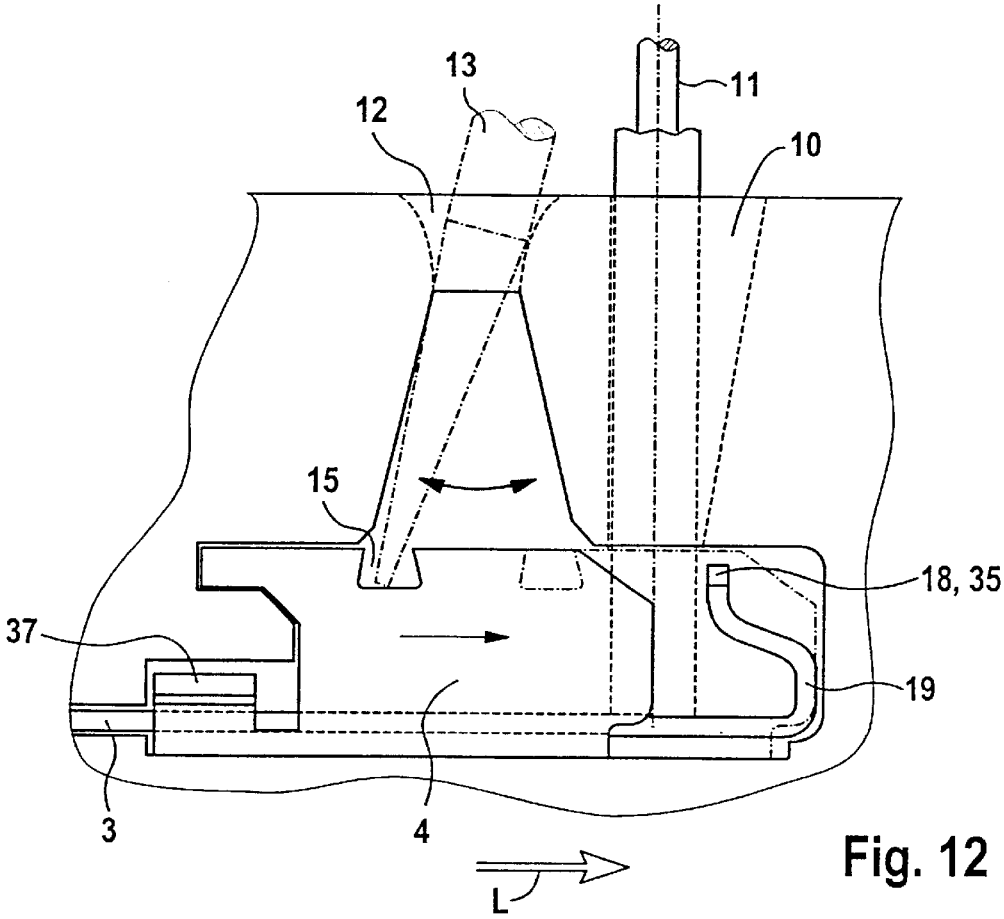

FIGS. 10 and 11 and FIG. 12 A frontal view and a view from above of the terminal according to FIG. 9, as well as an embodiment of the terminal with a lower and upper sliding contact, relative to the conductor rail.

Figure 13:
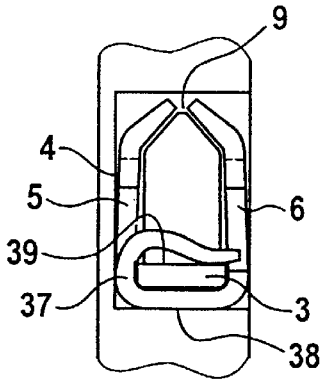
Figure 14:
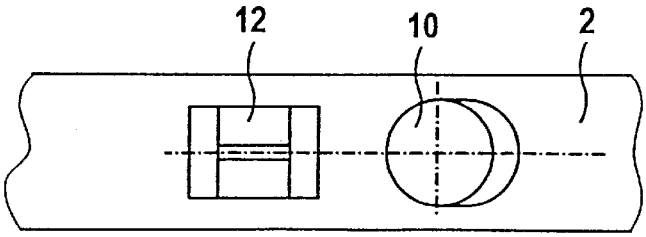

FIGS. 13 and 14 A view from the front and a view from the top of the terminal as shown in FIG. 12.

Figure 15:
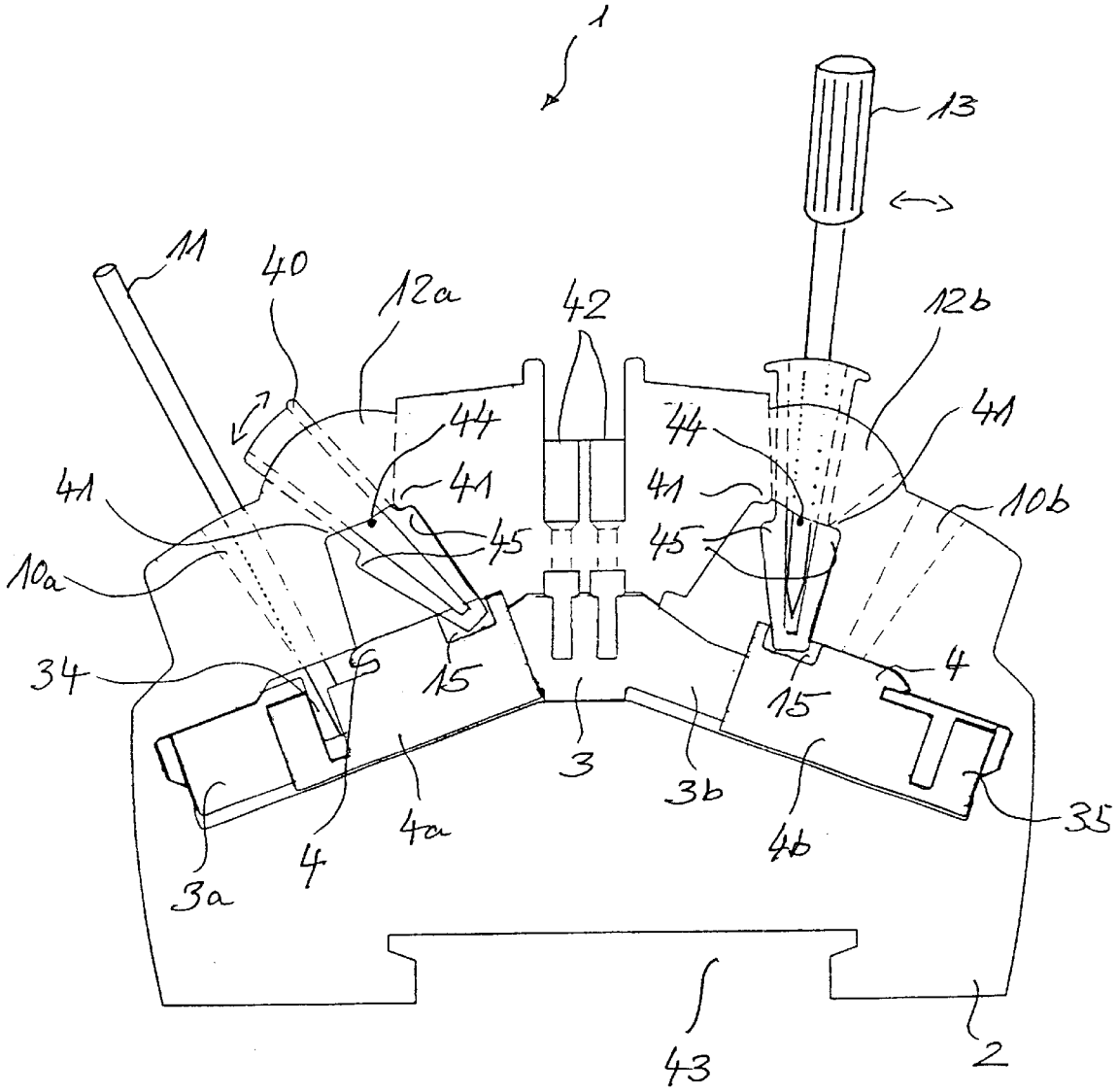

FIG. 15 A side view of a terminal with roof-shaped design of the conductor rail.

Figure 16:
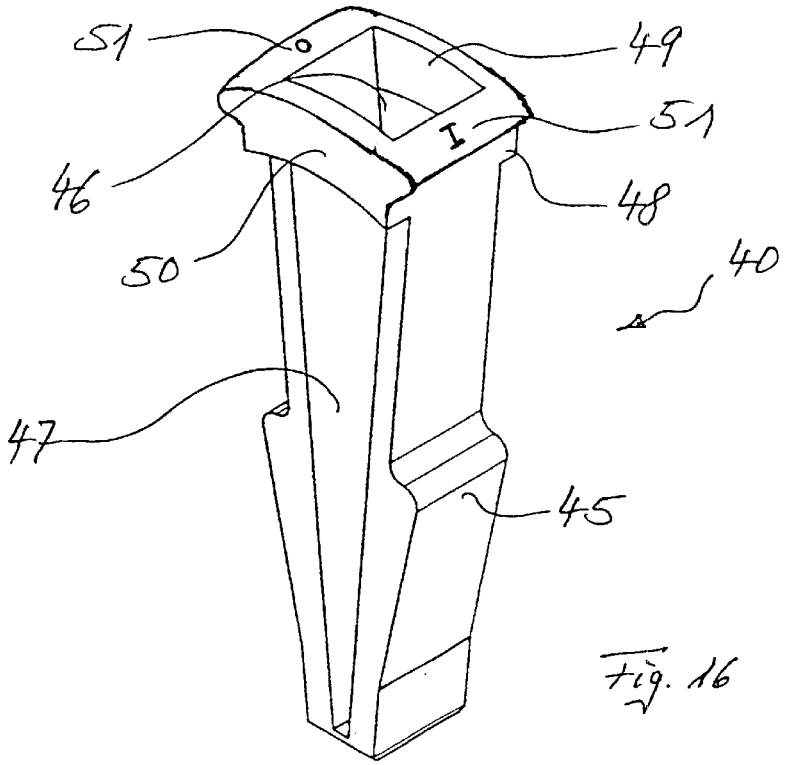

FIG. 16 An actuation element with a marking for the position of a contacting element for the terminal according to FIG. 15.

Figure 17:
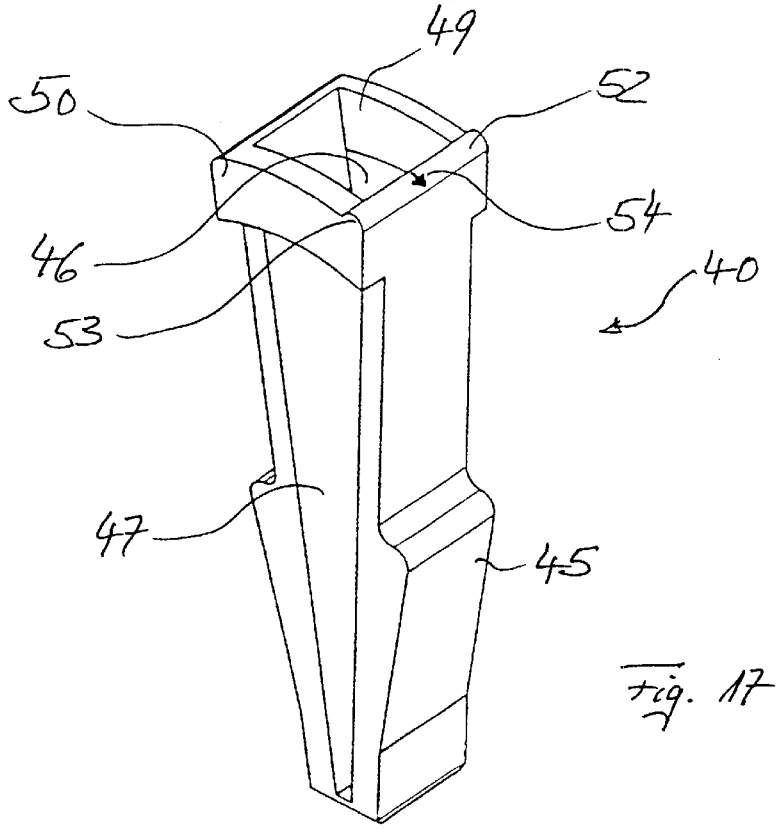

FIG. 17 An actuation element according to FIG. 16, with a display for the movement direction of the actuation element in the open position or the clamping position.

All corresponding components are provided with the same reference numbers in all Figures.

FIGS. 1 to 3 show a preferred embodiment of the screwless terminal 1, in a view from the side, a view from the front and a view from the top. The terminal 1, which is shown in sectional views, is preferably embodied as a so-called series terminal and comprises a terminal housing 2, of which only a so-called half shell provided with inside contours is shown. The terminal 1 furthermore comprises a locally fixed conductor rail 3 inside the terminal housing 2, as well as an insulation displacement contact 4, which is arranged such that it can be moved along the side or top of this rail. The terminal is U-shaped (FIG. 2) and has clamping legs 5, 6 that are bent toward each other. The free ends of these clamping legs are provided with blade-type cutting edges 7 or 8, between which a cutting and guide slot 9 is formed for the insulation displacement contacting of a conductor 11 that is inserted into the terminal housing 2 via a housing feed-through 10 (FIG. 1).

An additional through opening 12 is provided in front of the feed-through opening 10 in the terminal housing 2, in longitudinal rail direction L, which simultaneously functions as displacement or movement direction for the insulation displacement contact 4 along the conductor rail 3. An actuation tool 13, for example a screwdriver, can be inserted through this additional opening into the terminal housing 2. The through opening 12 is designed as funnel-shaped housing well, which is conically tapered toward a constriction point 14 of the funnel-shaped housing well 12 and from there expands again conically in the direction of insulation displacement contact 4. A dovetailed engagement recess 15 that is inserted in the region of the cutting edges 7, 8 for the insulation displacement contact 4 is aligned with this funnel-shaped housing well 12. The actuation tool 13 engages in this engagement recess for displacing the insulation displacement contact 4, relative to the locally fixed conductor rail 3, from the position shown herein to the position indicated with dash-dot line. For this, the actuation tool 13 supports itself in the manner of a lever on the constricted or narrowed point 14.

In the position shown herein, the conductor 11 that is inserted into the terminal housing 2 is immovably secured therein. For this, the conductor is supported by the wall of the housing feed-through 10, as well as by a support for the conductor 11 in the region between the conductor rail 3 and the cutting edges 7, 8 or of the insulation displacement contact 4. Guide bars 16, only one of which is visible, are formed onto these and extend in the direction of the housing feed-through 10. The guide bars 16 flank the end of conductor 11 and thus form the side support for the conductor. An additional back support on the inside of the terminal housing 2, in a longitudinal rail direction L behind the housing feed-through 10, forms a free end 189 and an inward-bent conductor rail section 19, which is bent upward, parallel to the insertion direction 17 of conductor 11.

A sliding contact space 21 is formed below the underside 20 of the conductor rail section 19. A sliding coupling 22 that is formed onto the underside of insulation displacement contact 4, opposite the cutting edges 7 and 8, and is bent upward in the direction of feed-through opening 10 is located inside this sliding contact space. As shown with the dash-dot line, this sliding coupling fits against the underside of the bent-in conductor rail section 19 as a result of the translational displacement of the insulation displacement contact 4 from the non-contacting functional position shown to the contacting functional position shown with dash-dot line. As a result, the electrically conducting connection between the insulation displacement contact 4 and the conductor rail 3 is established.

The insulation displacement contact 4 is locked in place in this contacting functional position, in which the cutting edges 7 and 8 cut through the conductor 11 insulation and make contact with the conductor core. A lock-in groove 23 is provided on the clamping coupling 16 or each clamping coupling, in which a detent 24 engages, which is formed resiliently onto the inside contour of the terminal housing 2. An additional lock-in connection, which engages in the open position shown herein, is also provided on the back of the insulation displacement contact 4, opposite the guide bars 16. A lock-in groove 25 is again formed into its top region, into which a resilient detent 26 engages.

One alternative embodiment of the screwless terminal 1 is shown in FIGS. 4 and 5, in the non-contacting or the contacting operating position. Shown is only the operational element of terminal 1, consisting of the conductor rail 3 and the insulation displacement contact 4, for the insulation displacement contacting of conductor 11. For this embodiment of terminal 1, the insulation displacement contact 4 is again displaced in the same way in a translational movement in longitudinal rail direction L and thus in the direction of conductor 11, which is held immovably and locally fixed inside the terminal housing 2. The insulation displacement contacting again occurs as a result of the cutting of the conductor insulation 11*a* with the cutting edges 7 and 8 of insulation displacement contact 4, until these make contact with the conductor core 11*b*.

In contrast to the embodiment shown in FIGS. 1 to 3, the electrically conducting connection between the insulation displacement contact 4 and the conductor rail 3 occurs by means of a sliding contact on the side. This sliding contact is realized with sliding couplings 27, which are formed onto the insulation displacement contact 4 and fit against opposite arranged side edges 28 of the conductor rail 3. This can be seen with comparable clarity in the exploded view of this functional element, shown in FIG. 6. The inward curved sliding couplings 27 of conductor rail 3 between them enclose a necked-down conductor rail region 29, which is formed by recesses 30 on both sides of the conductor rail 3. The recesses 30 thus simultaneously form stop edges 321 and 32 in the contacting or non-contacting operating position for the insulation displacement contact 4, which can be moved translationally along the conductor rail 3.

FIGS. 7 and 8 show a view from the front and a view from the top of the insulation displacement contact 4. In particular the view in FIG. 8 shows with comparable clarity the insertion and cutting slot 9 formed between the cutting edges 7 and 8 on the free ends of the terminal clamp legs 5 and 6, which are bent toward each other. Also visible is the position of the dovetailed engagement recess 15 with respect to the curved sliding couplings 27 on the one hand and a scarfed contour of an insertion slot 33 on the other hand. FIG. 8 furthermore shows the sleeve-shaped guide 34 for conductor 11, which extends in front of the cutting slot 9.

FIGS. 9 to 11 show another embodiment of the screwless terminal 1, again in a view from the side, from the front and from above. The terminal 1 with otherwise identical design and analog insulation displacement contacting function, deviates from the embodiment according to FIGS. 1 to 3 and 4 to 8 only in the manner, in which the electrically conducting connection between the insulation displacement contact 4 and the conductor rail 3 occurs. In this case, the connection is realized by means of a sliding contact provided in the central region of the conductor rail 3. For this, a conductor rail section 35 that is bent approximately in the rail center is raised up with its free ends in the direction of the housing feed-through 10, as shown in particular in FIG. 10. The raised conductor rail section extends between the two terminal legs 5 and 6 of the insulation displacement contact 4 and forms a contact coupling 35 for this embodiment. Sliding couplings 36, which are on the one hand formed onto the insulation displacement contact 4 and are raised up in the direction of the feed-through opening 10 and, on the other hand, are bent inward against the contact coupling 35, fit flush against this contact coupling. As a result, the sliding contact is established in the contacting operating position. The sliding couplings 36 are formed in the back onto the insulation displacement contact 4, which back is facing away from the insertion slot 33. To form the contact coupling 35, a section of the widened conductor rail can be provided with slots on both sides, crosswise to the longitudinal rail direction, in a manner not shown per se, and can subsequently be bent upwards. Alternatively, the contact coupling can be formed by twisting or turning a conductor rail section, provided with folds resulting from a corresponding folding over, which section is then bent parallel to the longitudinal rail direction and is thus set upright in the manner of a screw.

FIGS. 12 to 14 furthermore show a modified or alternative embodiment of the electrically conducting connection, relative to the embodiment shown in FIGS. 9 and 11, wherein a sliding contact coupling 37 is formed onto the insulation displacement contact 4, on the conductor rail side opposite the bent-in conductor rail section 19. As is shown with comparable clarity in FIG. 13, this coupling forms an upper and a lower sliding contact, relative to the conductor rail 3. Starting from the conductor rail underside 38, the sliding coupling 37 that extends crosswise to the longitudinal rail direction L, is guided with one side around the conductor rail 3 and makes contact with the conductor rail on the rail top 39. On the free end side, this sliding coupling 37 is bent outward in an approximate S shape to achieve a sufficient spring force in the direction of the conductor rail top 39. The sliding coupling 37 of insulation displacement contact 4 thus makes contact with the conductor rail underside 38 as well as the conductor rail top 39, so that a reliable, electrically conducting connection is established between the insulation displacement contact 4 and the conductor rail 3.

In accordance with the embodiment shown in FIG. 15, the terminal 1 comprises an approximately roof-shaped conductor rail 3, arranged inside the terminal housing 2, as well as two contacting elements 4*a* anb 4*b*, which are arranged so as to be displaceable on the two legs 3*a* and 3*b* of conductor rail 3. The separate contacting element 4*a*, 4*b* each encompasses the insulation displacement contact 4 and forms one structural unit with this contact. The terminal 1 therefore is provided with a double-sided insulation displacement contact 4. The legs 3 a, 3*b* of conductor rail 3, which are arranged at an angle to each other, permit the narrowest possible design for the terminal 1. In addition, the accessiblity from the outside is imnproved. Ther terminal housing 2 is provided on both sides with a feed-through opening or conductor channel 10*a* 10*b* for each separate electrical conductor 11, as well as with respectively one opening 12*a*, 12*b* as housing well for the intervention of actuation tool 13.

The actuation tool 13 is preferably a standard screwdriver. Respectively one actuation element 40 is inserted into the opening 12*a*, 12*b*, which holds the actuation tool 13. The terminal housing 2 is provided with respectively one projection 41 on the side, at the opening 12*a*, 12*b*. The actuation element 40 is pushed via a pressure point that is defined by the projection 41 into the terminal housing 2 and is held securely therein. In the fully assembled state, it is accessible from the outside.

In addition to the two insulation displacement contacts 4, the terminal 1 is also provided with two bushings 42 for the plug-in contacting, for example designed to accommodate connector pins. The terminal 1 thus offers a total of four connections and is embodied, in particular, as a series terminal to be arranged on a mounting rail or top hat rail. For this, the terminal is provided with a guide recess 43 on the underside. For the exemplary embodiment, the contacting element 4*a* that is shown in the left picture half is in the open position and the contacting element 4*b* shown in the right picture half is in the clamping position, following the contacting of conductor 11. The clamping position thus is the outer end position of the displacement contact 4 on the respective leg 3*a*, 3*b* of the conductor rail 3.

Each contacting element 4*a*, 4*b* in turn preferably has a U-shaped design and is provided on its upper end with two insulation displacement contact legs that are bent toward each other and serve to form an insulation displacement contact 4. The conductor insulation 11*a* is cut with these insulation displacement contact legs and the conductor 11 is clamped between the legs. For the contacting, the conductor 11 is inserted through the individual conductor channel 10*a*, 10*b* into the respective recess or guide 34 of conductor rail 3.

After the conductor 11 is inserted into the recess 34, the respective contacting element 4*a*, 4*b*, is moved in the direction toward the conductor 11, that is to say from the center of the terminal 1 toward the outside. In the process, the corresponding insulation displacement contact 4 cuts the conductor insulation 11*a* and makes contact with the conductor 11.

The actuation tool 13 is inserted into the actuation element 40 in order to move the insulation displacement contact 4 along the conductor rail 3. The actuation element loosely engages in the engagement recess 15, designed as cutout, of the corresponding contacting element 4*a*, 4*b*. Together with the actuation tool 13, the actuation element 40 is turned around an—imagined—rotational axis 44 and the displacement contact 4 is pushed, for example, into the clamping position. In the process, the projection 41 formed on the terminal housing 2 functions as support. The actuation element 40 thus is designed as a pivoting lever that can pivot around the rotational axis 44. In its lower region, this element has a wedge-shaped convexity 45 on the outside, which serves as counter support to the support formed by the projection 41.

The actuation element 40 accommodates the actuation tool 13 and inserts this tool into the terminal housing 2. For this, the actuation element is provided with a pocket-shaped holding area 46 (FIGS. 16 and 17). The actuation tool 13 therefore cannot come into direct contact with the operating and contacting element 4*a*, 4*b* and the insulation displacement contact 4, so that this contact is protected against damage.

According to FIG. 16, the actuation element 40 is designed as a wedge-shaped pivoting lever, with a holding area 46 that is also designed as a wedge-shaped slot 47. The actuation element 40 essentially comprises two protective sides, which are arranged between the actuation tool and the contact element 4*a*, 4*b* when the contacting element 4*a*, 4*b* is moved with the respective displacement contact 4 and by means of the actuation tool 13. The force exerted by the actuation tool 13 is transmitted by the protective sides to the contact element 4*a*, 4*b*.

The slotted design permits a very easy insertion of the actuation element 40 into the opening 12*a*, 12*b* of the terminal housing 2 because the two walls on the side of the actuation element 40 are bent toward each other. As soon as the actuation element with its convexity 45 is guided via the pressure point formed by the projection 41, the convexity 45 engages behind the projection 41. The actuation element 40 in particular is designed to be elastic for this. The material used is preferably plastic, which has advantages with respect to the desired protective function.

The actuation element 40 is provided with a head 48 on the end, which defines an insertion opening 49 for the actuation tool 13. The insertion opening 49 is completely bordered by the side webs 50 of head 48.

The head 48 is provided with a marking 51 on two of its side webs 50, an "0" and an "I" for the exemplary embodiment. This marking 51 indicates whether the contacting element 4*a*, 4*b* is in the clamping position "I" or in the open position "O." Since the head 48 of the actuation element 40 projects from the terminal 1, the position of the contacting element 4*a*, 4*b* and thus the displacement contact 4 is easily visible from the outside.

The actuation element 40 according to one alternative embodiment shown in FIG. 17 is provided with a display 52 for the movement direction of the actuation element 40, for example toward the clamping position. As shown in FIG. 17, the display 52 is formed by an elevation 53 of the head 48 that can be scanned. In addition, an arrow 54 is provided on this elevation 53. The display 52 and the marking 51 can be combined.

The terminal 1 with the actuation element 40 essentially has the advantage that the latter prevents the actuation tool 14 from damaging the contacting element 4*a*, 4*b* and thus the insulation displacement contact 4. The operational capacity of the terminal 1 is retained, even with repeated contacting and disconnecting of the contact. The actuation element 40 thus has a protective function. In addition, it serves as a guide for the actuation tool 13, so that this tool can be inserted easily and safely. In particular, it prevents damage to the elements inside the terminal 1, which may be caused by inserting the actuation tool 13, which is achieved through the design for the terminal housing 2 with projection 41 and the convexity 45 at the actuation element 40. This type of design furthermore prevents that the actuation element 40 can fall out of the terminal 1. The display of the position of contacting element 4*a*, 4*b* or the display of the movement direction to the open or clamping position must be seen as a fourth function of the actuation element 40.

| Reference Number List | |
|---|---|
| 1 | terminal |
| 2 | terminal housing |
| 3 | conductor rail |
| 3a,b | leg |
| 4 | insulation displacement contact |
| 4a,b | contact element |
| 5,6 | clamping leg |
| 7,8 | cutting edge |
| 9 | guide/cutting slot |
| 10 | feed-through opening |
| 10a,b | guide channel |
| 11 | electrical conductor |
| 11a | conductor insulation |
| 11b | conductor core |
| 12 | housing well |
| 12a,b | opening |
| 13 | actuation tool |
| 14 | constricted/narrowed point |
| 15 | engagement recess |
| 16 | guide bar |
| 17 | insertion direction |
| 18 | free end |
| 19 | conductor rail section |
| 20 | underside |
| 21 | sliding contact space |
| 22 | sliding coupling |
| 23 | lock-in groove |
| 24 | detent |
| 15 | lock-in groove |
| 26 | detent |
| 27 | sliding coupling |
| 28 | side edge |
| 29 | conductor rail region |
| 30 | recess; cutout |
| 31,32 | stop edge |
| 33 | insertion slot |
| 34 | guide |
| 35 | contact coupling |
| 36,37 | sliding coupling |
| 38 | underside of conductor rail |
| 39 | top of conductor rail |
| 40 | actuation element |
| 41 | projection |
| 42 | bushings |
| 43 | guide opening |
| 44 | rotational axis |
| 45 | convexity |
| 46 | holding space |
| 47 | slot |
| 48 | head |
| 49 | insertion opening |
| 50 | side web |
| 51 | marking |
| 52 | display |
| 53 | elevation |
| 54 | arrow |
| L | longitudinal direction/displacement direction |

What is claimed is:

1. A screwless terminal (1), in particular a series terminal, comprising a conductor rail (3) inside a terminal housing (2) and therewith electrically connected insulation displacement contact (4), provided with opposite arranged cutting edges (7,8) between which an electrical conductor (11) is contacted, which conductor is inserted via a housing feed-through (10) into the terminal housing (2), wherein the insulation and displacement contact has legs with said cutting edges (7,8) formed on the ends thereof, said legs being bent toward each other to form a cutting and guide slot (9), and the insulation displacement contact (4) is arranged so as to be movable along the conductor rail (3), wherein an insulation displacement contacting of the immovably positioned conductor (11) occurs through a translational movement of the insulation displacement contact (4) along with the conductor rail (3) in longitudinal conductor rail direction (L).

2. A terminal according to claim 1, wherein the conductor (11) is positioned in the terminal housing (2), inside a sleeve-shaped guide (34), which is formed above the cutting edges (7,8) by the housing feed-through (10) and below the cutting edges (7,8) by guide bars (16) that are formed onto the insulation displacement contact (4) and extend in longitudinal rail direction (L), wherein the conductor (11) is held between these guide bars.

3. A terminal according to claim 1, wherein the insulation displacement contact (4) is provided with a preferably dove-tailed engagement recess (15) for an actuation tool (13).

4. A terminal according to claim 3, wherein a funnel-shaped housing well (12) for inserting the actuation tool (13), which is conically tapered in insertion direction and, starting with the constricted section (14), is conically expanded in the direction of the engagement recess (15).

5. A terminal according to claim 1, wherein a contacting element (4*a*,4*b*) is provided for carrying out a relative movement between the conductor (11) and the insulation displacement contact (4), which element can be moved with the aid of an actuation tool (13) that can be inserted from the outside into the terminal housing (2) and cooperates with an actuation element (40) inside the terminal housing (2), wherein said actuation element is designed such that a direct contact between the actuation tool (13) and the contacting element (4*a*, 4*b*) is avoided.

6. A terminal according to claim 5, wherein the actuation element (40) is provided with a holding space (46) for the actuation tool (13).

7. A terminal according to claim 5, wherein the actuation element (40) loosely engages in the contacting element (4*a*, 4*b*).

8. A terminal according to claim 5, wherein the actuation element (40) has a flexible design.

9. A terminal according to claim 5, wherein the actuation element (40) has a one-piece design.

10. A terminal according to claim 5, wherein the actuation element (40) is provided with a display (52) for the movement direction toward the open position or the clamping position.

11. A terminal according to claim 5, wherein the actuation element (40) has a marking (51) for the position of the contacting element (4*a*, 4*b*).

12. A terminal according to claim 5, wherein the contacting element (4*a*,4*b*) encompasses the insulation displacement contact (4).

13. A connecting device with two clamping locations, designed as terminals in accordance with claim 5, wherein a conductor rail (6) with two legs (10), arranged at an angle to each other, which are respectively connected to one insulation displacement contact (11).

14. A terminal according to claim 5, wherein the actuation element (40) is arranges so that it cannot be lost inside the terminal housing (2).

15. A terminal according to claim 14, wherein the terminal housing (2) is provided with a projection (41) as support for the actuation element (40) and that the actuation element (40) snaps into this support.

16. A terminal according to claim 15, wherein the projection (41) defines a rotational axis (44) for the actuation element (40).

17. A terminal according to claim 15, wherein the actuation element (40) is designed as pivoting lever with a wedge-shaped convexity (45) as counter support for the support.

18. A screwless terminal (1), in particular a series terminal, comprising a conductor rail (3) inside a terminal housing (2) and therewith electrically connected insulation displacement contact (4), provided with opposite arranged cutting edges (7,8) between which an electrical conductor (11) is contacted, which conductor is inserted via a housing feed-through (10) into the terminal housing (2), wherein the insulation displacement contact (4) is arranged so as to be movable along the conductor rail (3), wherein an insulation displacement contacting of the immovably positioned conductor (11) occurs through a translational movement of the insulation displacement contact (4) along with the conductor rail (3) in longitudinal conductor rail direction (L), the conductor (11) is positioned in the terminal housing (2), inside a sleeve-shaped guide (34), which is formed above the cutting edges (7,8) by the housing feed-through (10) and below the cutting edges (7,8) by guide bars (16) that are formed onto the insulation displacement contact (4) and extend in longitudinal rail direction (L), wherein the conductor (11) is held between these guide bars, and the guide bar (16) or each guide bar is (are) provided on the free end with a lock-in groove (23) into which a flexible detent (24) engages during the insulation displacement contacting of conductor (11), which detent is formed resiliently onto the inside of terminal housing (2).

19. A screwless terminal (1), in particular a series terminal, comprising a conductor rail (3) inside a terminal housing (2) and therewith electrically connected insulation displacement contact (4), provided with opposite arranged cutting edges (7,8) between which an electrical conductor (11) is contacted, which conductor is inserted via a housing feed-through (10) into the terminal housing (2), wherein the insulation displacement contact (4) is arranged so as to be movable along the conductor rail (3), wherein an insulation displacement contacting of the immovably positioned conductor (11) occurs through a translational movement of the insulation displacement contact (4) along with the conductor rail (3) in longitudinal conductor rail direction (L), and the electrically conducting connection between the displacement contact (4) and the conductor rail (3) occurs by means of a sliding contact on the side, wherein the displacement contact (4) is provided with a sliding coupling (27) that fits flush against one side edge (28) of the conductor rail (3).

20. A terminal according to claim 19, wherein the conductor rail (3) has a necked-down design in the sliding-contact region.

21. A screwless terminal (1), in particular a series terminal, comprising a conductor rail (3) inside a terminal housing (2) and therewith electrically connected insulation displacement contact (4), provided with opposite arranged cutting edges (7,8) between which an electrical conductor (11) is contacted, which conductor is inserted via a housing feed-through (10) into the terminal housing (2), wherein the insulation displacement contact (4) is arranged so as to be movable along the conductor rail (3), wherein an insulation displacement contacting of the immovably positioned conductor (11) occurs through a translational movement of the insulation displacement contact (4) along with the conductor rail (3) in longitudinal conductor rail direction (L), and the electrically conducting connection between the conductor rail (3) and the insulation displacement contact (4) occurs with a sliding coupling (22), formed onto the displacement contact and extending in longitudinal rail direction (L), which sliding coupling is bent outward toward a bent-in conductor rail section (19) and fits against its underside (20).

22. A terminal according to claim 21, wherein the inward-bent conductor rail section (19) is provided with a free end (18), which is bent upward in the direction of the housing feed-through (10) and serves as conductor contact web.

23. A screwless terminal (1), in particular a series terminal, comprising a conductor rail (3) inside a terminal housing (2) and therewith electrically connected insulation displacement contact (4), provided with opposite arranged cutting edges (7,8) between which an electrical conductor (11) is contacted, which conductor is inserted via a housing feed-through (10) into the terminal housing (2), wherein the insulation displacement contact (4) is arranged so as to be movable along the conductor rail (3), wherein an insulation displacement contacting of the immovably positioned conductor (11) occurs through a translational movement of the insulation displacement contact (4) along with the conductor rail (3) in longitudinal conductor rail direction (L), and the electrically conducting connection between the insulation displacement contact (4) and the conductor rail (3) occurs by means of a lower and/or upper sliding contact, relative to the conductor rail (3), wherein a sliding coupling (37) that is formed onto the insulation displacement contact (4) and is bent inward, transverse to the longitudinal rail direction (L), makes contact with the conductor rail underside (38) and/or the conductor rail top (39).

24. A screwless terminal (1), in particular a series terminal, comprising a conductor rail (3) inside a terminal housing (2) and therewith electrically connected insulation displacement contact (4), provided with opposite arranged cutting edges (7,8) between which an electrical conductor (11) is contacted, which conductor is inserted via a housing feed-through (10) into the terminal housing (2), wherein the insulation displacement contact (4) is arranged so as to be movable along the conductor rail (3), wherein an insulation displacement contacting of the immovably positioned conductor (11) occurs through a translational movement of the insulation displacement contact (4) along with the conductor rail (3) in longitudinal conductor rail direction (L), and the electrically conducting connection between the insulation displacement contact (4) and the conductor rail (3) occurs by means of a sliding contact provided in the center region of the conductor rail (3), wherein at least one sliding coupling (36) that is formed onto the insulation displacement contact (4) and is fitted against the contact coupling (35) makes contact with a contact coupling (35) that is formed onto the conductor rail (3) and is bent upward in the direction of the cutting edges (7,8).

25. A terminal according to claim 24, wherein the sliding coupling (36) or each sliding coupling is (are) formed onto the back of the insulation displacement contact (4), which is facing away from an insertion slot (33).

26. A terminal according to claim 24, wherein a widened conductor rail section that is provided with a slot on both sides in longitudinal rail direction (L) is bent upward to form the contact coupling (35).

27. A terminal according to claim 24, wherein the contact coupling (35) is formed by a conductor rail section that is bent upward in the manner of a screw.

* * * * *